US007222632B2

(12) United States Patent
Gagosz

(10) Patent No.: US 7,222,632 B2
(45) Date of Patent: May 29, 2007

(54) PUBLIC CONVENIENCE EQUIPPED WITH A FLOOR CLEANING DEVICE

(75) Inventor: Jean-Claude Gagosz, Bu (FR)

(73) Assignee: J. C. Decaux International, Neuilly-Sur-Seine (FR)

( * ) Notice: Subject to any disclaimer, the term of this patent is extended or adjusted under 35 U.S.C. 154(b) by 402 days.

(21) Appl. No.: 10/885,050

(22) Filed: Jul. 6, 2004

(65) Prior Publication Data

US 2005/0055767 A1 Mar. 17, 2005

(30) Foreign Application Priority Data

Jul. 4, 2003 (FR) ..... 03 08194

(51) Int. Cl.
*B08B 3/02* (2006.01)

(52) U.S. Cl. ..... 134/166 R; 134/159 R; 4/663

(58) Field of Classification Search ..... 4/664; 134/166 RR, 169 R, 15 R
See application file for complete search history.

(56) References Cited

U.S. PATENT DOCUMENTS

| | | | | |
|---|---|---|---|---|
| 3,230,550 | A * | 1/1966 | Carlson | 4/597 |
| 3,720,961 | A * | 3/1973 | Garvey | 4/662 |
| 3,837,011 | A * | 9/1974 | McTighe et al. | 4/662 |
| 3,869,732 | A * | 3/1975 | Garvey et al. | 4/662 |
| 4,642,821 | A * | 2/1987 | Zanuso et al. | 4/662 |
| 4,718,131 | A * | 1/1988 | Kitamura et al. | 4/663 |
| 4,922,559 | A * | 5/1990 | Wall | 4/662 |
| 4,957,114 | A * | 9/1990 | Zeng et al. | 600/476 |
| 5,647,074 | A * | 7/1997 | White et al. | 4/664 |
| 5,978,986 | A * | 11/1999 | Lunow et al. | 4/664 |
| 6,349,430 | B1 * | 2/2002 | Forslund | 4/662 |

FOREIGN PATENT DOCUMENTS

| | | | |
|---|---|---|---|
| EP | 0 645 499 | | 3/1995 |
| FR | 2 744 743 | | 8/1997 |
| GB | 370829 | | 4/1932 |
| JP | 6-17461 | * | 1/1994 |
| JP | 8-103399 | * | 4/1996 |
| JP | 8-232329 | * | 9/1996 |
| JP | 11-287468 | * | 10/1999 |
| JP | 20065584 | * | 1/2000 |

OTHER PUBLICATIONS

European Office 0 365 320 10/19989.*

* cited by examiner

*Primary Examiner*—Frankie L. Stinson
(74) *Attorney, Agent, or Firm*—Marshall, Gerstein & Borun LLP

(57) ABSTRACT

There is provided a convenience comprising a frame, a floor and a floor cleaning device, said floor cleaning device comprising a water feeding conduit and a water dispensing nozzle, connected to said conduit and opening close to the floor, said nozzle comprising a neck having two converging surfaces facing each other, one of which is formed in the frame of the convenience.

14 Claims, 5 Drawing Sheets

PUBLIC CONVENIENCE EQUIPPED WITH A FLOOR CLEANING DEVICE

FIELD OF THE DISCLOSURE

The invention relates to the cleaning of public conveniences.

BACKGROUND OF THE DISCLOSURE

In order to increase hygiene of a public convenience, it is known since quite some time to clean its floor in an automatic and regular way, e.g. after each utilization thereof.

The purpose is not limited to washing the floor from footprints and possible splashes resulting from the utilization of the toilet. It is also directed to clear the floor from encumbering garbage (paper, newspapers, cans, etc.).

The applicant proposed few years ago an installation for dispensing water on the floor, for cleaning a sanitary unit.

This installation, which is disclosed in European patent application published under number EP-A-0 645 499, dispenses water on the floor by means of a nozzle, the water being recycled through a collecting tank.

Although such an installation is satisfactory, for it reduces water, consumption, the inventors have decided to further improve the quality of cleaning.

SUMMARY OF THE DISCLOSURE

To this end, the invention provides a convenience comprising a frame, a floor and a floor cleaning device, said floor cleaning device comprising a water feeding conduit and a water dispensing nozzle, connected to said conduit and opening close to the floor, said nozzle comprising a neck having two converging surfaces facing each other, one of which is formed in the frame of the convenience.

The manufacturing of the nozzle, which is ordinarily quite complex and costly, is thereby simplified. It is therefore possible to increase the width of the nozzle and thus cover the entire floor surface area, thereby increasing the quality of cleaning.

According to one embodiment, one surface of the neck is formed in the frame of the convenience, whereas the other is formed by a separate section fixed to the frame, the converging surfaces being preferably planar.

The section comprises e.g. a pipe butt-jointed to the feeding conduit, whereas the frame may comprise a low wall on which the section is mounted, said low wall having a cut-out for allowing water to pass through, said pipe opening in front of said cut-out.

According to one embodiment, the frame comprises an underframe, on which the floor is mounted, and which forms one of the converging surfaces of the neck. The feeding conduit is located between the underframe and the floor.

The feeding conduit may be disposed in a groove formed in the underframe.

The nozzle may also comprise a deflector butt-jointed to said neck and opening in the vicinity of the floor, said deflector being so, shaped as to canalize the water, flow in order to form a water jet tangent to the floor.

The deflector comprises e.g. two canalizing cylindrical surfaces facing each other, which are C-shaped in section.

According to another embodiment, the frame comprises a side wall adjacent the floor, in which wall one of the converging surfaces of the neck is formed.

Furthermore, the convenience may comprise a basin for collecting garbage drained by the cleaning water, and also a water-recycling pump connected, on the one hand, to the collecting basin and, on the other hand, to the feeding conduit.

The above and other objects and advantages of the invention will become apparent from the detailed description of preferred embodiments of the invention, considered in conjunction with the accompanying drawings.

BRIEF DESCRIPTION OF THE DRAWINGS

FIG. 1 shows a public convenience 1 suitable for being installed on public areas in order to satisfy public needs.

DETAILED DESCRIPTION OF THE DISCLOSURE

Figure 1:
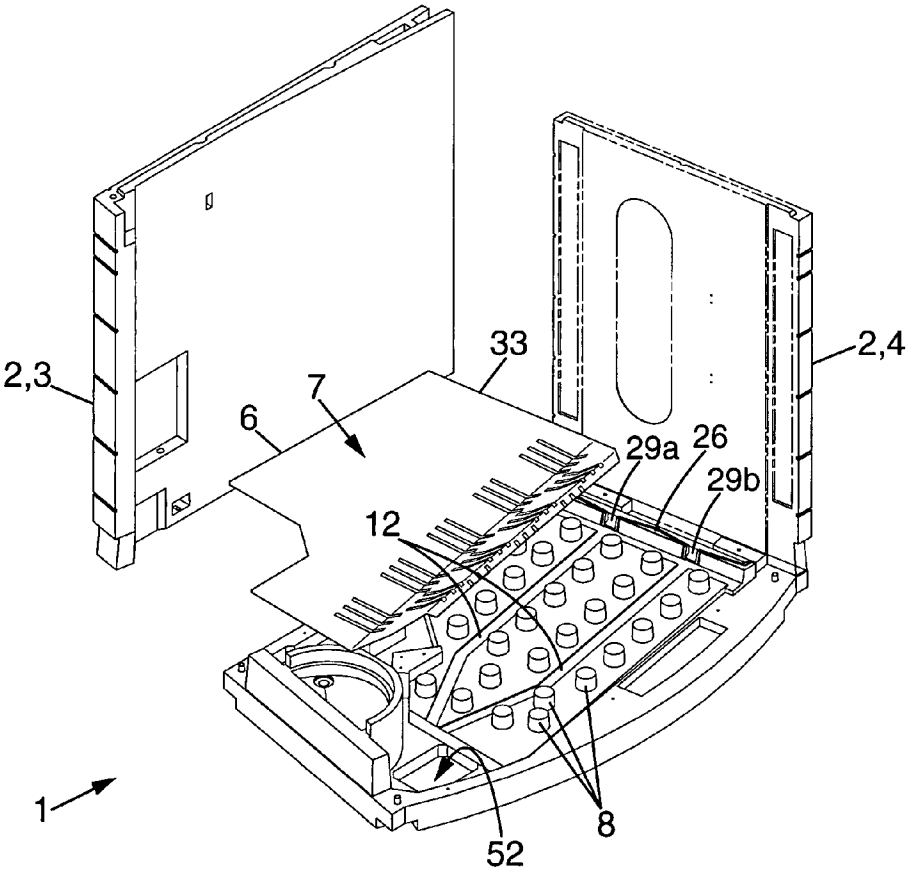
FIG. 1 is an exploded perspective view of a public convenience.
Figure 3:
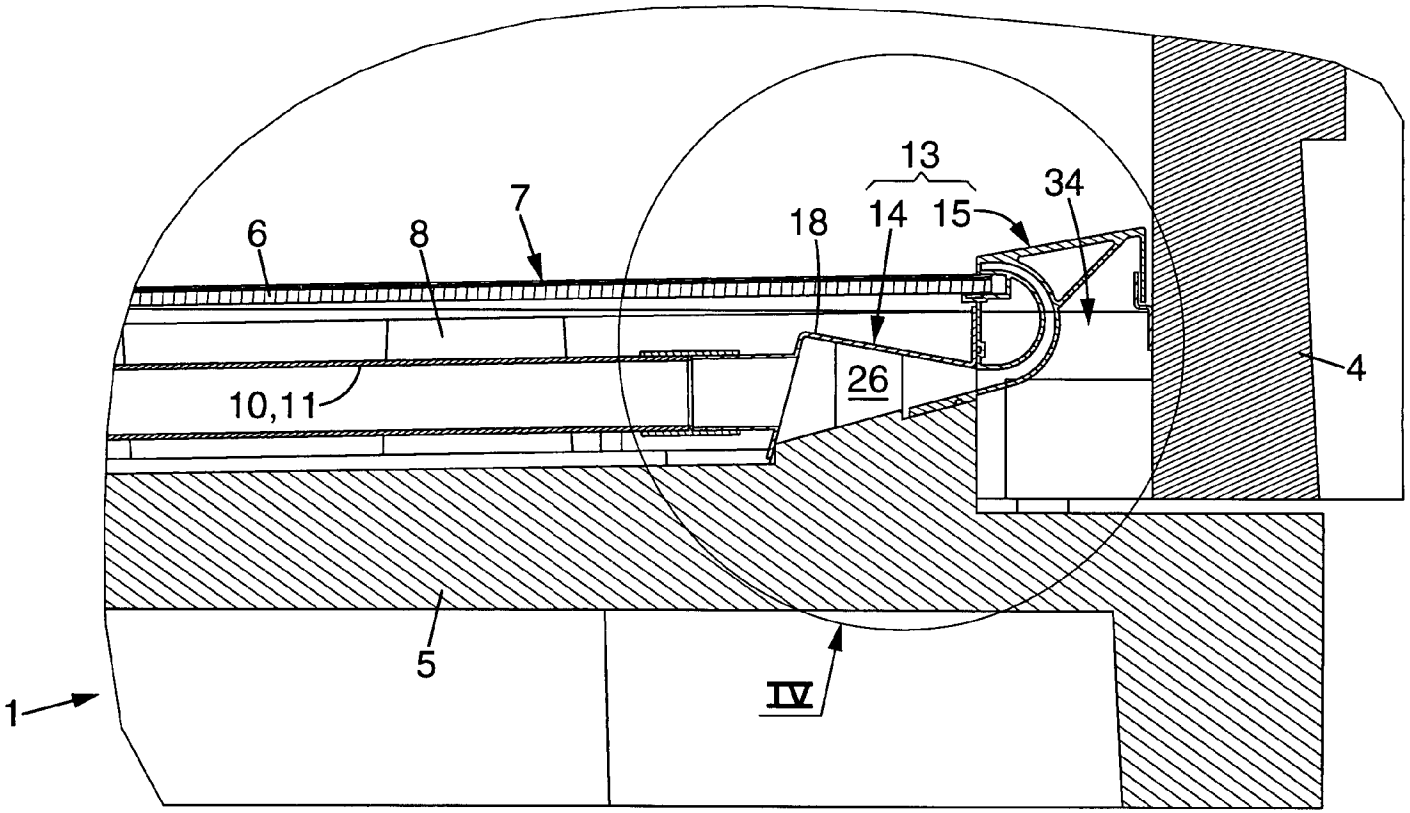
FIG. 3 is an elevational cut view of the public convenience of FIG. 1, equipped with the cleaning device of FIG. 2.

Convenience 1 comprises a frame 2 having a global parallelepipedic shape, which comprises side walls (two of which, referenced 3, 4, are shown on FIG. 1) and also a concrete-molded underframe 5 supporting a floor 6, an upper surface 7 of which forms the floor plan of the convenience 1.

Figure 5:
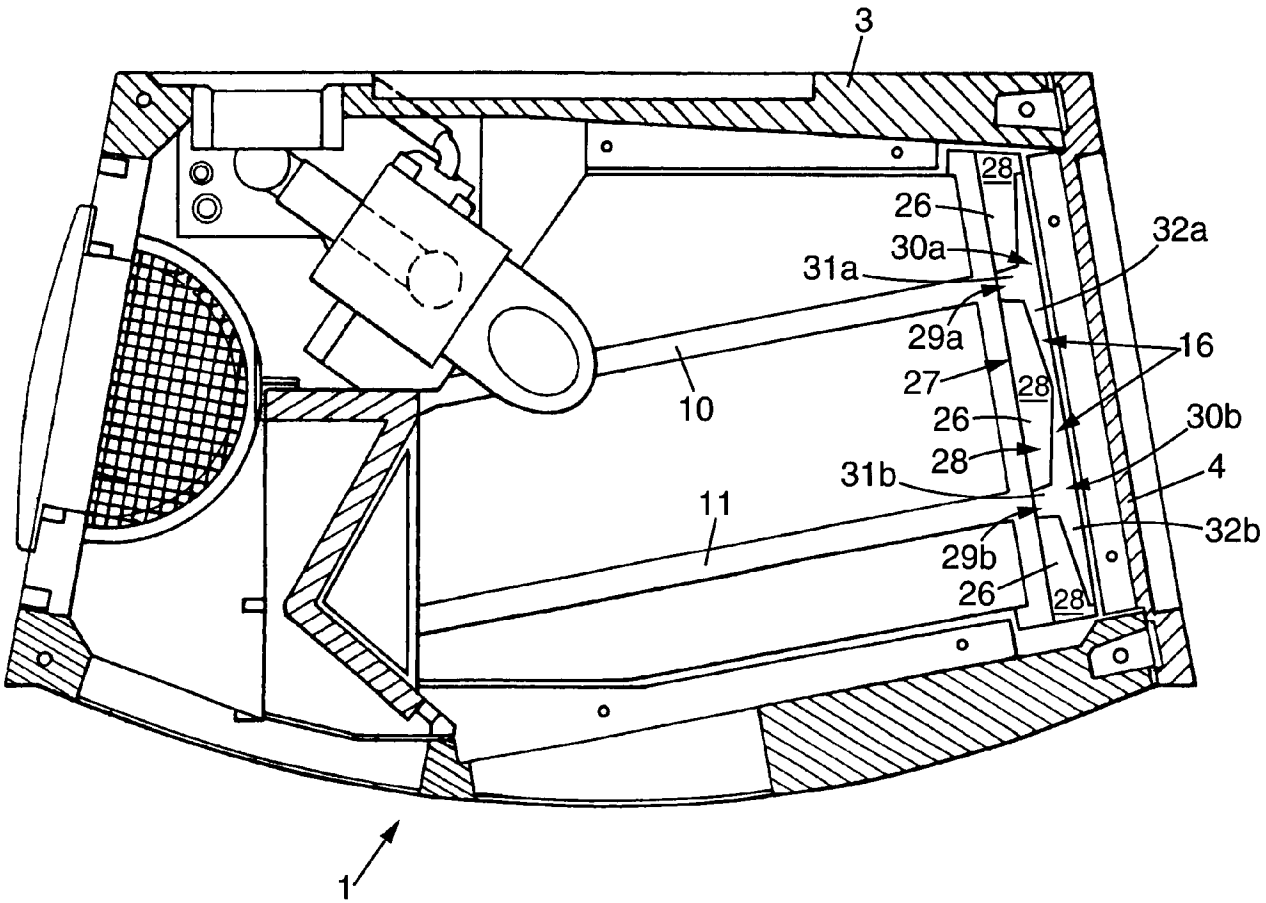
FIG. 5 is a top plan view of the public convenience of FIG. 1.
Figure 6:
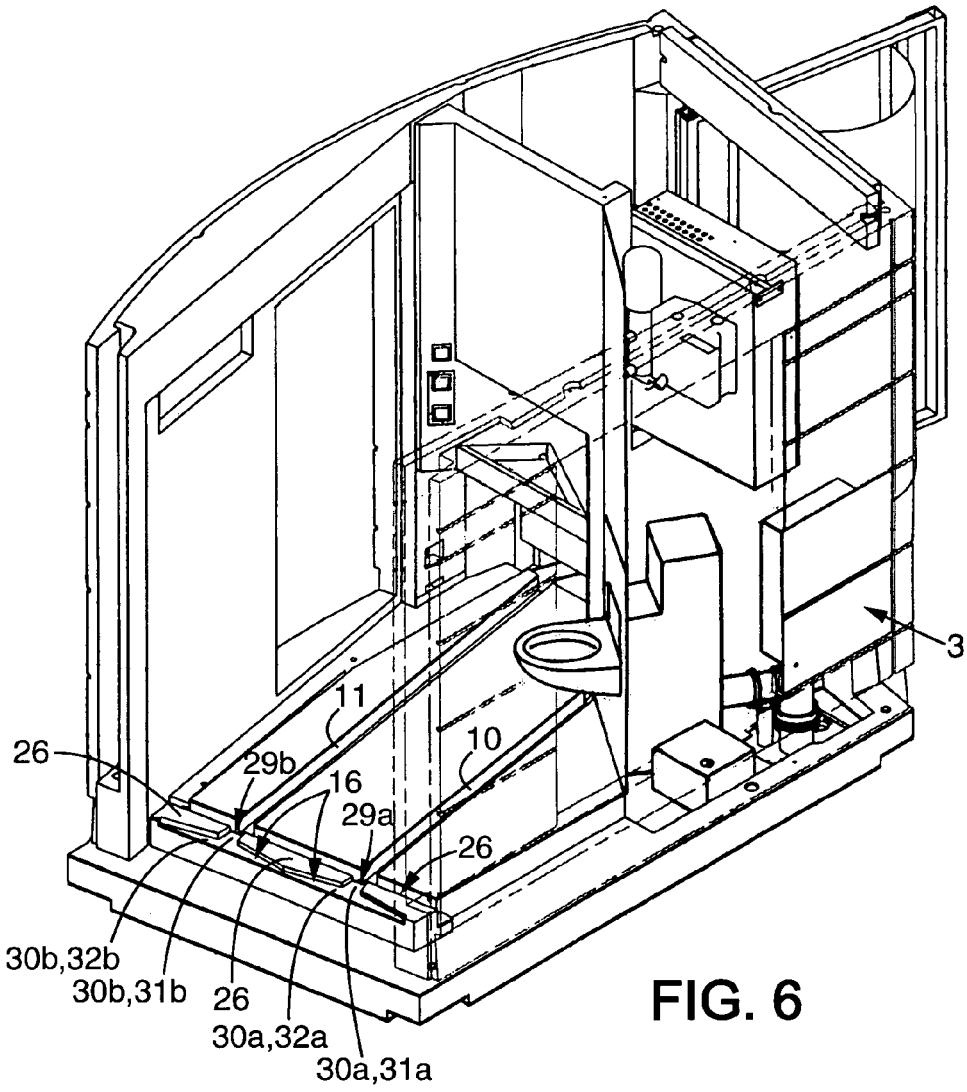
FIG. 6 is a perspective view of the public convenience of FIG. 1, along another angle of sight.

More precisely, floor 6 is floating and supported by studs 8 equipping the underframe 5 (for clarity reasons, the studs are not shown on FIGS. 5 and 6). Silent blocks (not shown) may be interposed between floor 6 and studs 8, in order to deaden the floor 6 and muffle the convenience 1, thereby increasing the comfort thereof.

Figure 2:
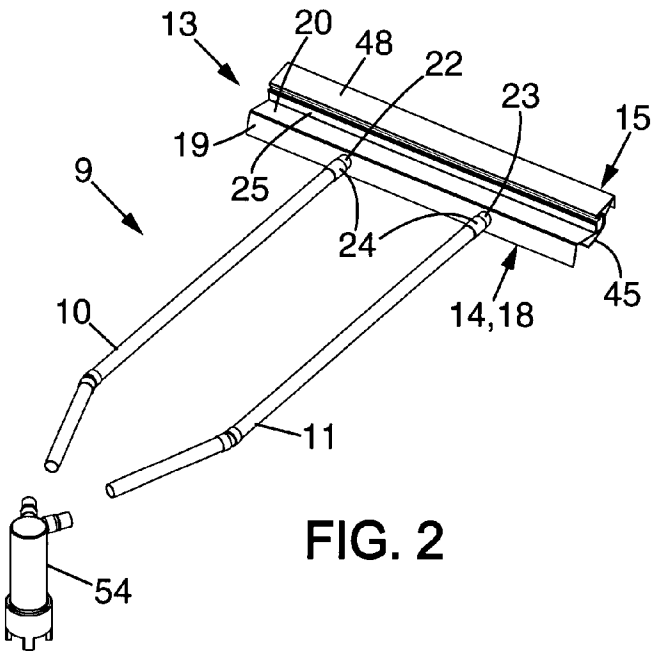
FIG. 2 is an exploded perspective view of a cleaning device equipping a public convenience as represented on FIG. 1.

The convenience 1 further comprises a water-projecting floor cleaning device 9, which comprises one or more water feeding conduits 10, 11—two in the depicted example, as shown on FIG. 2—substantially parallel, located under the floor 6 (more precisely, between the floor 6 and the underframe 5). The water feeding conduits 10, 11 are embedded in two parallel grooves 12 formed into the underframe 5 between two adjacent stud lines.

The cleaning device 9 also comprises a nozzle 13 for dispensing water, connected to the conduits 10, 11 and opening in the vicinity of the floor 6.

This nozzle 13 is so designed as to form a substantially planar water blade which, as soon as cleaning is triggered—either in a manual or automatic way—sweeps across the floor plan 7.

The nozzle 13 canalizes the water flow so as to transform it from a circular section (at the end of the conduits 10, 11) into a flat rectangular section (before its projection toward the floor plan 7).

To this end, the nozzle 13 comprises, first, a neck 14 which is connected to the conduits 10, 11, and, second, a deflector 15 which is butt-jointed to the neck 14 on the side opposite to the conduits 10, 11.

Figure 4:
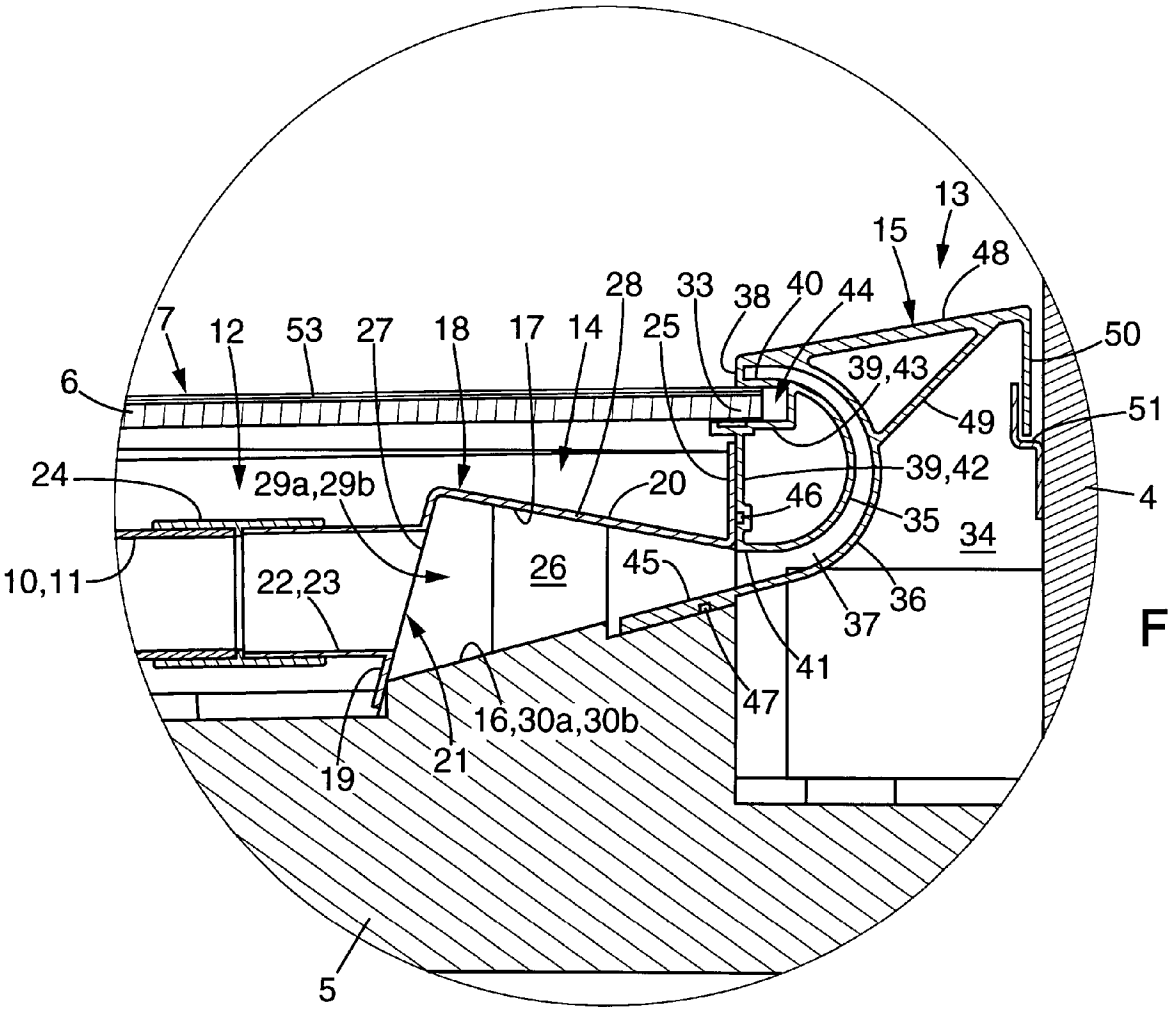
FIG. 4 is an enlarged cut view of detail IV on FIG. 3.

As depicted on FIG. 4, the neck 14 has a V-shaped section, and comprises two planar surfaces facing each other which converge on the side opposite to the conduits 10, 11, i.e. a lower surface 16 and an upper surface 17.

As depicted on FIG. 4, the lower surface 16 is formed in the frame 2—more precisely in the underframe 5—whereas the upper surface 17 is formed by a separate section 18 fixed to the frame 2.

This section 18, which is made e.g. by steel plate binding, is corner-shaped, and comprises two substantially planar flanges 19, 20 at right angle, i.e.:

- an upstream flange with two circular holes 21 formed therethrough, each of which is edged with a linking pipe 22, 23 butt-jointed, by means of a coupling sleeve 24, to the corresponding feeding conduit 10, 11, and
- a downstream flange 20 in prolongation of the upstream flange 19 and the internal face of which (i.e. the one facing the underframe 5) forms the upper surface 17 of the neck 14.

In addition, as depicted on FIG. 4, the downstream flange 20 has, on the side opposite to the upstream flange 19, a bounded edge 25 which facilitates fixation of the deflector.

The underframe 5 comprises a small wall 26, which is molded during the manufacturing of the underframe 5, and on which the section 18 is mounted.

This small wall 26 comprises a front surface 27, against which the upstream flange 19 is applied, and an upper surface 28, against which the downstream flange 20 is applied (FIG. 4).

The small wall 26 comprises two cut-outs 29*a*, 29*b* (FIG. 1) for allowing passage of the water flow coming out from the conduits 10, 11, in front of which the pipes 22, 23 as soon as section 18 is correctly positioned on the small wall 26.

The lower surface 16 of the neck 14 is formed by two inclined ramps 30*a*, 30*b* which, from an upper point of view (see FIG. 5), have a flat mushroom shape. Each ramp 30*a*, 30*b* comprises a first portion 31*a*, 31*b* of low width, defined by the cut-out 29*a*, 29*b*, and a second portion 32*a*, 32*b* of large width, in the prolongation of first portion 31*a*, 31*b*, which goes larger behind the small wall 26—that is to say on the side opposite the front surface 27.

As depicted on FIG. 5, the second portions 32*a*, 32*b* are abutted, so that the water coming out from the conduits 10, 11 merges, thereby forming at the end of the neck a single flow having a flat rectangular shape.

The deflector 15 is a monolithic metallic section, manufactured e.g. by aluminum-alloy molding. In order to make the deflector 15 fit the neck 14 at one end thereof, there is provided an interstice 34 between one end 33 of the floor 6 and the facing side wall 4.

The deflector 15 is so manufactured as to canalize the flow coming out from the neck 14, thereby forming a water jet tangent to the floor 6.

To this end, the deflector 15 comprises two substantially gutter-shaped or C-shaped coaxial cylindrical walls for canalizing the water, i.e. an internal wall 35 and an external wall 36. The internal facing surfaces of the walls 35, 36 define together, in the prolongation of the neck 14, a conduit 37 having a flat rectangular section which opens above and adjacent the floor 7 through a rectangular opening 38.

The deflector 15 comprises a wall 39 which connects an upper edge 40 and a lower edge 41 of the internal cylindrical wall 35. This wall 39 comprises, on the side of the lower edge 41, a vertical portion 42 which is applied against the edge 25 of the section 18 and through which the deflector is fixed to the section 18. Wall 39 also comprises, on the side of the upper edge 40, a right angled lip 43 which, together with the upper edge 40, defines a housing 44 in which the end 33 of the floor 6 is introduced.

A lip 45 is provided in the prolongation of the cylindrical external wall 36, on the side opposite to the opening 38, said lip 45 being applied against the lower surface 16 of the neck 14, so as to stabilize the deflector 15 while it in the right position.

In addition, in order to seal the link between the neck 14 and the deflector 15, the vertical portion 42 of the wall 39 and the lip 45 both comprise grooves 46, 47 in which sealing joints are embedded, so that the sealing joints are compressed between, on the one hand, the vertical portion 42 and the edge 25 and, on the other hand, the lip 45 and the lower surface 16.

Furthermore, a the deflector comprises a cantilever table 48 extending from the opening 38 to the side wall 4 in order to conceal interstice 34.

As depicted on FIG. 4, the deflector 15 comprises a stiffening wing 49 connecting the external cylindrical wall 36 to the table 48, and also a vertical wing 50 which extends in the prolongation of the table 48 and is embedded in a sustaining lug 51, thereby fixing the deflector 15 to the wall 4.

As disclosed hereinbefore, the nozzle 13, which is in formed partly in the frame 2 (more precisely in the underframe 5) and partly in one or more separate pieces (i.e. section 18 and deflector 15). Accordingly, the dimensions of the nozzle 13 may be increased—in particular its width (i.e. perpendicular to the water flow), which is thus not limited.

Therefore, the nozzle 13 may lie all along the side wall 4, so that the cleaning water sweeps across the whole floor plan 7.

As soon as cleaning of the floor plan 7 is triggered, the water supplied by the conduits 10, 11 to the nozzle is projected through opening 38, forming a flat water blade which sweeps across the floor 6 in a direction opposite to the side wall 4.

Although this does not appear on the figures, the floor 6 is inclined so that the cleaning water is drained toward a garbage collecting basin 52 (including paper, cans, etc.). The drained garbage is thereafter collected by housekeeping personnel.

In order to facilitate the draining of garbage on the floor 6, the floor plan 7 comprises grooves 53 parallel to the water flow direction, i.e. perpendicular to the side wall 4, so that the cleaning water, flowing in the grooves 53, lifts the garbage and drains it toward the collecting basin 52.

Furthermore, in order to reduce water consumption, the water circuit of the cleaning device 9 may be of the closed type. To this end, the water circuit comprises e.g. a pump 54 connected, on the one hand, to the collecting basin 52, where sewage is pumped out, and, on the other hand, to the feeding conduits 10, 11 wherein the water collected in the basin 52 is pulsed toward the nozzle 13.

Although the basin 52 is designed to collect most of the garbage, e.g. by means of a grille (not shown), some dirt may remain in the water. In order to clean the dirty water, the pump 54 may be equipped with a filter, which may be of the removable type so as to be replaced whenever it is necessary.

Mounting the cleaning device 9 is simple, as will be explained now.

First, the deflector 15 is mounted onto the section 18, the vertical portion 42 being applied against and fixed to the edge 25, e.g. by means of screws.

The coupling sleeves 24 are then coupled to the pipes 22, 23, which are thereafter butt-jointed to the conduits 10, 11, whereas the coupling sleeves 24 are coupled to the conduits 10, 11.

The conduits 10, 11 are then installed in the corresponding grooves 12 and connected to the pump 54 (FIG. 2). The section 18 is mounted on the small wall 16, whereas the vertical wing 50 is introduced in the sustaining lug 51.

The floor 6 is thereafter provided, the end 33 thereof being introduced in the housing 44.

Although the conduits 10, 11 extend under the floor 6 in the disclosed embodiment, the invention is not limited to this particular construction.

In an alternative embodiment, the conduits may run in or on the side wall 4, which needs no deep change in the design of the cleaning device. Practically, the orientation of the nozzle shall be modified: instead of being oriented horizontally, the nozzle shall extend vertically along. Others side wall 4, which shall form the lower surface of the neck instead of the underframe (as described hereabove). This kind of construction is as simple to manufacture and mount as the above-described construction.

The invention claimed is:

1. Convenience comprising a frame including side walls and at least an underframe, a floor covering said underframe, and a floor cleaning device, said floor cleaning device comprising a water feeding conduit and a water dispensing nozzle connected to said conduit and opening close to the floor, said nozzle comprising a neck having two converging surfaces facing each other, wherein a first one of the converging surfaces is formed in the frame of the convenience, and a second one of the converging surfaces is formed by a separate section, the separate section joinable to the frame.

2. Convenience according to claim 1, wherein the converging surfaces are planar.

3. Convenience according to claim 2, wherein the section comprises a pipe butt-jointed to the feeding conduit.

4. Convenience according to claim 3, wherein the frame comprises a low wall on which the section is mounted, said low wall having a cut-out for allowing water to pass through, said pipe opening in front of said cut-out.

5. Convenience according to claim 4, wherein the frame comprises an underframe, on which the floor is mounted, and which forms one of the converging surfaces of the neck.

6. Convenience according to claim 5, wherein the feeding conduit is located between the underframe and the floor.

7. Convenience according to claim 6, wherein the feeding conduit is disposed in a groove formed in the underframe.

8. Convenience according to claim 1, wherein the nozzle comprises a deflector butt-jointed to said neck and opening in the vicinity of the floor, said deflector being so shaped as to canalize the water flow in order to form a water jet tangent to the floor.

9. Convenience according to claim 8, wherein the deflector comprises two canalizing cylindrical surfaces facing each other.

10. Convenience according to claim 9, wherein the canalizing cylindrical surfaces are C-shaped in section.

11. Convenience according to claim 1, wherein the frame comprises a side wall adjacent to the floor, in which wall one of the converging surfaces of the neck is formed.

12. Convenience according to claim 1, further comprising a basin for collecting garbage drained by the cleaning water.

13. Convenience according to claim 12, wherein the cleaning device comprises a water-recycling pump connected, on the one hand, to the collecting basin and, on the other hand, to the feeding conduit.

14. Convenience comprising:

a frame including side walls and an underframe;

a floor arranged for mounting over the underframe;

a floor cleaning device, the floor cleaning device comprising at least one water supply conduit and a water dispensing nozzle in flow communication with the at least one conduit, the nozzle including an opening adjacent to the floor; and the nozzle comprising a neck formed in part by converging first and second surfaces facing one another, at least a portion of the underframe forming a portion of the first surface, the second surface formed separately from the first surface and joinable to the frame.

* * * * *